United States Patent [19]

Larsen

[11] Patent Number: 4,462,319

[45] Date of Patent: Jul. 31, 1984

[54] METHOD AND APPARATUS FOR SAFELY CONTROLLING EXPLOSIONS IN BLACK LIQUOR RECOVERY BOILERS

[75] Inventor: Theodore E. Larsen, Edina, Minn.

[73] Assignee: Detector Electronics Corp., Minneapolis, Minn.

[21] Appl. No.: 437,671

[22] Filed: Oct. 27, 1982

[51] Int. Cl.[3] ..... F23G 7/04; A62C 35/08

[52] U.S. Cl. ..... 110/238; 122/7 C; 122/504; 122/505; 169/28; 162/1

[58] Field of Search ..... 122/504, 7 C, 505, 506; 169/45, 28, 61, 47; 110/238; 162/1

[56] References Cited

U.S. PATENT DOCUMENTS

| | | | |
|---|---|---|---|
| 1,832,777 | 11/1931 | Hurtubise | 122/505 |
| 3,183,864 | 5/1965 | Stengel | 122/504 |
| 3,403,642 | 10/1968 | Parkin | 110/346 |
| 3,447,895 | 6/1969 | Nelson | 423/357 |
| 3,615,175 | 10/1971 | Nelson | 122/504 |
| 3,878,897 | 4/1975 | Goffant | 169/28 |
| 3,964,390 | 6/1976 | Medlock | 169/28 |
| 3,976,580 | 8/1976 | Kaminstein et al. | 169/47 |
| 4,106,978 | 8/1978 | Nelson | 162/1 |
| 4,231,430 | 11/1980 | Byun | 162/61 |
| 4,328,867 | 5/1982 | Heath | 169/28 |

FOREIGN PATENT DOCUMENTS

| | | | |
|---|---|---|---|
| 731952 | 4/1966 | Canada | 122/7 C |

*Primary Examiner*—Henry C. Yuen

[57] ABSTRACT

Apparatus and method is disclosed for monitoring black liquor recovery boilers to detect the presence of water leakage into the combustion chamber (furnace) of a black liquor recovery boiler, or extinguishing of flame at the black liquor spray nozzles, to release into the furnace at a relatively high rate of speed an absorption agent to collect the water in the furnace and thereby isolate the water from the smelt, and further to provide a medium from which the water may be evaporated to expedite cooling within the furnace without risk of a water/smelt explosive reaction. The apparatus includes propulsion devices for distributing the absorption agent over the furnace smelt, which propulsion devices are controlled by sensors respectively detecting boiler steam pressure, water pressure, and combustion flame. Manual actuation of the propulsion devices is also contemplated by the invention.

12 Claims, 8 Drawing Figures

METHOD AND APPARATUS FOR SAFELY CONTROLLING EXPLOSIONS IN BLACK LIQUOR RECOVERY BOILERS

BACKGROUND OF THE INVENTION

The present invention relates to a method and apparatus for safely controlling the undesired reactions in black liquor recovery boilers. More specifically, the invention relates to the control of explosive reactions in black liquor recovery boilers, caused principally by the escape or leakage of water into contact with the smelt product which may accumulate in the furnace of the recovery boiler.

Prior art patents which have focused on this problem have suggested various solutions for preventing explosive reactions in black liquor recovery boilers. For example, U.S. Pat. No. 3,447,895, issued June 3, 1969 teaches a method of preventing explosions by introducing onto the smelt in the furnace an aqueous quenching solution to rapidly cool the smelt bed to temperatures below the explosive range. U.S. Pat. No. 3,615,175, issued Oct. 26, 1971 teaches the introduction of a solid compound capable of highly endothermic chemical reaction upon thermal decomposition in the furnace. The decomposition reaction serves to inert the furnace with a non-flammable gas produced, thereby eliminating further production in the recovery process and solidifying the molten smelt. U.S. Pat. No. 4,106,978, issued Aug. 15, 1978 discloses the addition of a porous, high surface area powder which is coated with an anti-wetting agent. U.S. Pat. No. 3,403,642, issued Oct. 1, 1968 discloses an apparatus for increasing the temperature of the char bed upon detection of excessive water leakage into the furnace, to consume the char bed as quickly as possible while keeping furnace temperatures high enough to consume hydrogen which may be produced at this time.

Black liquor recovery boilers are critical elements in the implementation of an industrial process known as the Kraft pulping process which is used in many paper mills in the United States and throughout the world. The Kraft process is a closed-loop chemical process for producing long-fiber pulp used for making high strength paper from a variety of organic materials, usually wood. In the implementation of this process, wood logs are typically debarked and chipped into very small pieces, and fed into a digester where they are cooked in a solution of sodium hydroxide and sodium sulfide. This solution is known as "white liquor", and steam is added to the process for a number of hours to help dissolve the lignin binder which holds the wood fibers together.

After the cooking step has been performed the cellulose fibers are separated from the remaining solution, which is called "black liquor", and are further prepared for use and manufacture into paper. The dilute black liquor is usually run through one or more evaporation steps to increase the solids concentration to 62–65 percent, which is necessary for combustion.

The black liquor is ultimately heated and pressurized, typically to 220° F.–240° F. at 15–30 psig, and is fed through spray nozzles projecting into the black liquor furnace. The nozzles produce rather coarse droplets which are sprayed into the furnace interior and allowed to drop downwardly under the influence of gravity. Inside the furnace, a flame burns which acts upon the droplets as they fall toward the bed of the furnace. At boiler startup, the flame is supplied by auxiliary burners, but the black liquor combustion eventually becomes self-sustaining and the auxiliary burners are shut off. Burning of the black liquor accomplishes an evaporation of water from the droplets as they fall, and a partial combustion of the liquor solids within the droplets themselves.

This process produces significant amounts of heat, which is recovered in the furnace through the use of pipes running through the furnace. The inorganic constituents which remain from the burning process drop to the bed of the furnace, into what is known as a "char bed." Continued combustion in the char bed produces a reducing atmosphere which converts sodium sulfate to sodium sulfide, one of the chemicals desired for re-use in the Kraft process. The molten chemicals in the char bed are referred to as "smelt", a chief constituent in the smelt being sodium sulfide, which occurs as a result of the reduction of the sodium sulfate constituents sprayed into the furnace. This material is permitted to continuously drain into a dissolving tank where it is quenched and dissolved in a weak wash to form what is known as "green liquor".

The chemical recovery process in the black liquor recovery boiler is both efficient and safe as long as the furnace and all related equipment is physically sound, and as long as the black liquor emitted from the spray nozzles has been properly concentrated and is capable of sustained burning as it leaves the nozzles. However, should water come into contact with the smelt accumulated on the furnace floor of the recovery boiler, violent explosions can occur. The history of black liquor recovery boilers is replete with such incidents, and considerable time and effort has been expended toward understanding the exact cause of these explosions and devising methods to prevent them from occurring. Several principal theories have evolved, and two are described in the various prior art patents cited herein. One theory holds that the explosions are physical in nature, resulting from "encapsulation" of water in the smelt bed. Another theory holds that the explosions are chemical in nature, resulting from the evolution of explosive gases when moisture comes in contact with the smelt. The cited patent references teach various methods and systems for preventing smelt/water explosions, but the problem still exists in the pulp and paper industry. More recently, the theory centering on explosions resulting from interface of two or more liquids having significantly different temperatures has been applied to explain the smelt/water interface. It is theorized that water in contact with molten smelt first dissolves a quantity of smelt, forming a solution known as green liquor. This green liquor has a superheat temperature much higher than that of water, thus accommodating the requirements for liquid/liquid interface explosions.

The sodium sulfide which is produced as a result of the burning process is highly reactive with water, and upon contact with moisture forms hydrogen sulfide, a highly toxic and combustible gas. The recovery furnace itself contains water and steam pipes used for the collection of heat, and further contains water cooled drainage pipes for draining the smelt from the furnace, all of which can create an extremely dangerous environment if leakage should occur. Further, the burning process is initially ignited by means of externally fueled burners, but once the process begins it is self sustaining through the burning of the black liquor which is sprayed into the furnace. If the flame goes out during this burning process the unburned black liquor will settle into the smelt at the bottom of the furnace, bringing with it quantities of unevaporated water which may quickly accumulate in the smelt. As noted above, this will result in the release of hydrogen sulfide gas which could produce an explosion. However, the prior art patents suggest that the smelt/water explosions will occur even when sodium sulfide is not present. Since the other chemicals in the smelt, principally sodium sulfate and sodium carbonate and perhaps sodium sulfite, do not evolve explosive or flammable gases when in contact with moisture, it is therefore evident that factors other than flammable gas reactions are involved. On the other hand, the teachings of the prior art indicate that there is more difficulty in controlling explosions that occur in smelts having high sulfide content, which suggests that something more is involved than the physical "encapsulation" of water, as discussed above.

Explosions in black liquor furnaces may be very violent, and can cause much destruction and even loss of life. Therefore, it is important to develop techniques and apparatus for responding to conditions within the black liquor furnace which, if uncontrolled, will result in one or more explosions. Further, it is desirable to initiate corrective process steps upon the detection of a hazardous condition to neutralize the chemical occurring within the smelt, to prevent the cumulative buildup of reactive agents and thereby to prevent any explosion.

The continued existence of explosion problems in black liquor recovery demonstrates that the prior art inventions are either not effective or are not sufficiently practical in application, or a combination of both, and improvements in the art are necessary and desirable.

SUMMARY OF THE INVENTION

The present invention employs a combination of techniques for the effective control of smelt/water explosions, and addresses the problem as having potential in both physical and chemical reactions.

The method of the present invention comprises the steps of monitoring the pressures of water and steam constituents associated with the furnace, and monitoring the black liquor nozzle flames within the furnace, to detect conditions indicative of impending explosive reactions, and in response to a condition which is indicative of an impending explosive reaction to rapidly and relatively completely saturate the smelt with absorption agents for isolating the water in the furnace from the smelt. These absorption agents immediately collect and absorb water present on or in the smelt, and subsequently permit water evaporation through formation of steam above the smelt bed. The evaporation process is a cooling process which causes the entire smelt bed or substantially all the smelt bed to become converted from the liquid to the solid form, thus eliminating the liquid/liquid interface and preventing explosive reactions between the smelt and water.

The apparatus of the present invention comprises either a manually activated system, or pressure sensing means for detecting pressure variations in water and steam lines associated with the furnace, flame detector means for detecting radiation within the furnace, storage and propelling means immediately adjacent the furnace for storing absorption agents, and control means for activating the propelling means in response to signals received from the various sensors, which signals are indicative of impending explosive reactions, and for propelling absorption agents stored within the storing means into the smelt within the furnace to isolate the collected water from the smelt.

It is therefore a principal object of the present invention to provide a safety method and apparatus for determining the probable presence of water in a black liquor furnace, and for taking corrective action upon detecting the probable presence of excess water to rapidly arrest the chemical and physical composition within the furnace to prevent the explosive reaction with water.

It is another object of the present invention to provide a method and apparatus for monitoring the burning of black liquor being sprayed from nozzles into the furnace and initiating actions to absorb the water arriving at the smelt in the event of flameout, before explosions can occur.

It is a further object of the present invention to convert the products of the black liquor furnace to nonreactive products in the event of leakage or breakdown of related elements to the process.

BRIEF DESCRIPTION OF THE DRAWINGS

The foregoing and other objects and advantages will become apparent from a reading of the following specification and claims, and with reference to the appended drawings, in which:

DESCRIPTION OF THE PREFERRED EMBODIMENT

Figure 1:
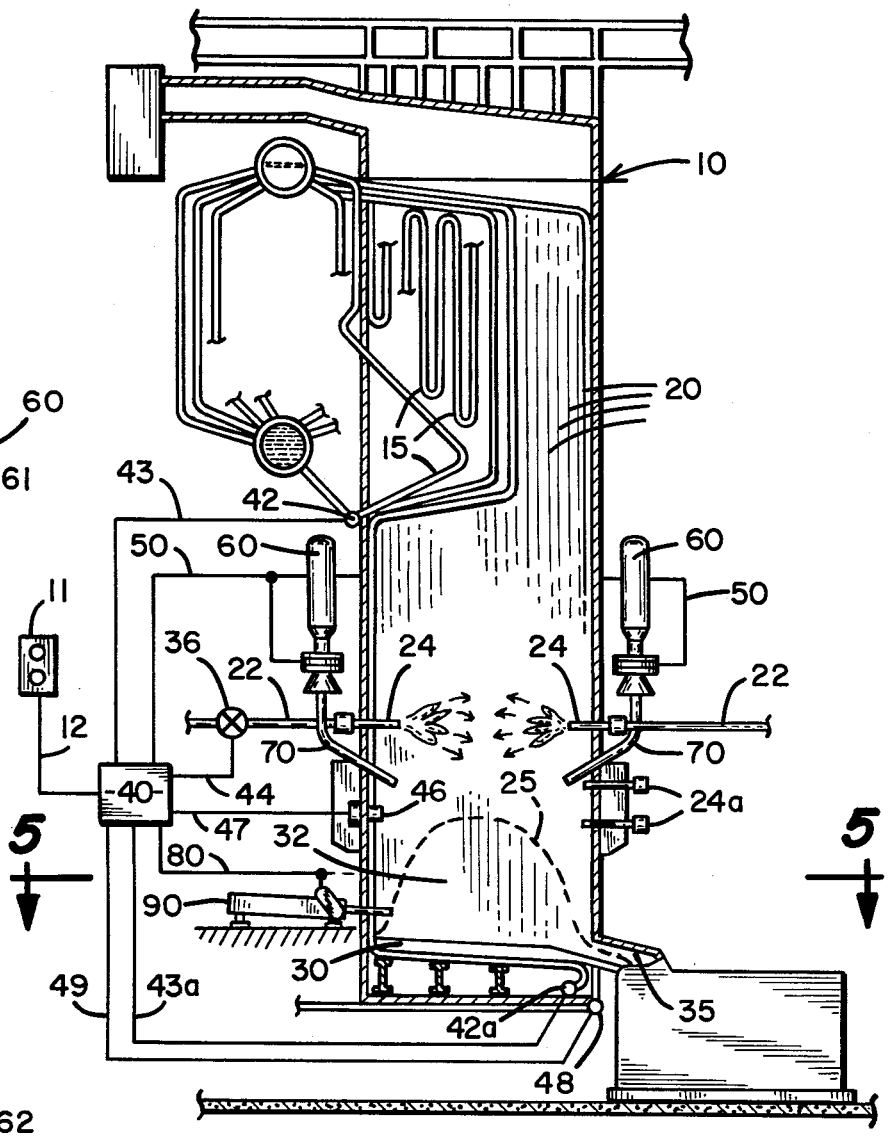
FIG. 1 shows a symbolic diagram of a black liquor furnace having the invention attached thereto.

Referring first to FIG. 1, there is shown in symbolic form a black liquor furnace generally designated as 10 having therein all of the elements essential for an understanding of the present invention. A plurality of steam and water pipes 15 and 20 are provided in furnace 10 for the purposes of recovering heat generated by the flame which may be present at nozzles 24, above char bed 25, or by auxiliary burners 24*a*. Black liquor is fed into inlet pipes 22, which terminate in one or more sprayers 24 inside furnace 10, which sprayers provide a spray of coarse droplets of black liquor into the combustion chamber of furnace 10. The droplets emitted at sprayer 24 drop toward the furnace floor 30, and in the process the flame evaporates water from the droplets and burns some of the solid waste byproduct. This solid waste byproduct continues to burn and permits the flame at the nozzles to become self-sustaining in the course of operating the furnace. As the process continues, furnace floor 30 gradually accumulates an increasing quantity of smelt 32, and a smelt drain spout 35 drains off the accumulations of smelt. Drain spout 35 directs the smelt to other elements in the process (not shown) for further conversion steps of the smelt. A flow control valve 36 may be adjusted to control the flow of black liquor flowing into the furnace via inlet pipe 22 and nozzles 24.

The temperature of smelt 32 is in the range of 1500°-2000° F., and smelt drain spout 35 is cooled by a water jacket 37, which circulates cooling water around the smelt drain in order to prevent the temperature of the smelt drain spout from rising to smelt temperature, which may be above the melting temperature of drain spout 35.

A control circuit 40 monitors various parameters of the ongoing process relating to furnace 10. For example, a pressure sensor 42 is connected into steam pipes 15 to monitor the pressure of the steam developed therein. Pressure sensor 42 is coupled to control circuit 40 by means of a signal line 43. Pressure sensor **42*a* is connected into the flow path of pipes 20 and is coupled to control circuit 40 by signal line 43*a*. Flow valve 36 is of the type which may be actuated by external drive means, and signal line 44 is coupled to flow valve 36 and its drive means to generate a signal indicative of the on/off state of flow valve 36. The signal on line 44 therefore provides an indication of whether black liquor is flowing through inlet pipe 22. A flame detector 46 is connected through a wall of furnace 10, and is directed toward the spray nozzles' flame so as to monitor the presence or absence of flame in the liquor sprayed from nozzles 24. Flame detector 46 is coupled to circuit 40 by means of signal line 47. The pressure of water fed through water jacket 37 may be externally controllable, and is monitored by a pressure gauge 48 which is connected via a signal line 49 to control circuit 40. A manual signal station 11 is coupled to control circuit 40 by a signal line 12, and is arranged to provide a manual command to the control circuit 40** and the signals to be hereinafter described.

Control circuit 40 therefore has the necessary signal inputs to enable it to monitor the steam and water line pressure, water jacket 37 pressure, flow valve 36 position, flame detector 46 output, and manually entered signals from station 11. All of these signals are received by control circuit 40, and are processed in a manner to be hereinafter described, to generate output signals on line 50.

Line 50 is coupled to one or more storage and propulsion cannons 60, and a signal on line 50 causes cannons 60 to become activated. Cannons 60 are mounted adjacent the outside of furnace 10, and are mounted cooperatively with chutes 70 which project through the wall of furnace 10, in a direction generally aimed at smelt 32, for releasing and propelling absorption elements toward smelt 32. The construction of cannons 60 are identical.

Line 80 is coupled to a plurality of extensible pressure ejectors 90. A signal on line 80 causes pressure ejectors 90 to eject absorption granules into smelt 32, and at the same time causes extensible nozzles on each of the pressure ejectors 90 to move inwardly into furnace 10. The construction of pressure ejectors 90 are identical.

Figure 2:
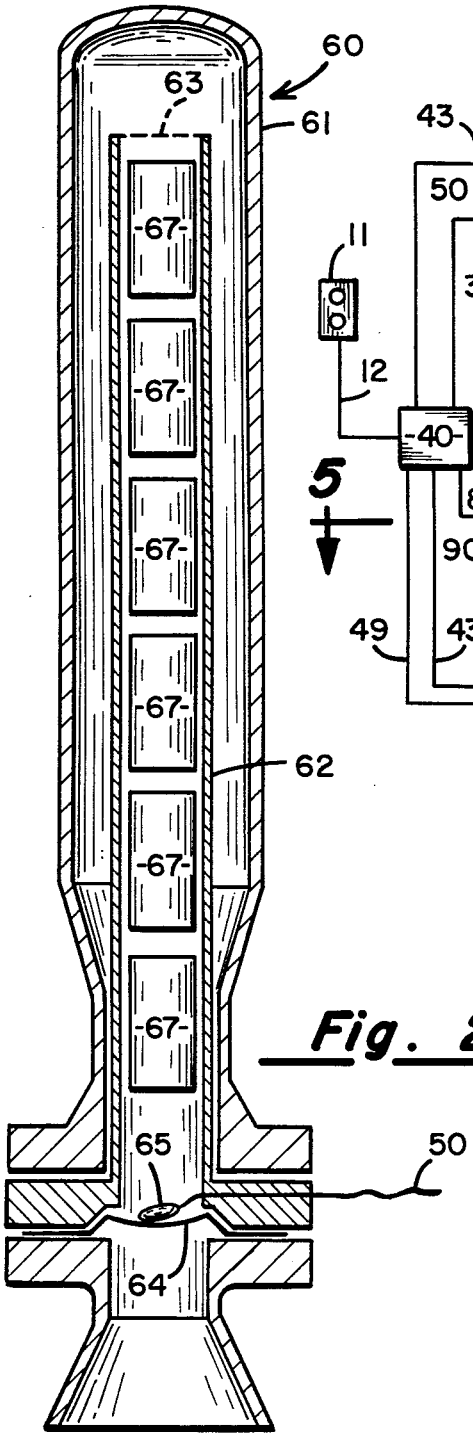
FIG. 2 shows a symbolic diagram of one form of propelling and storing means.

FIG. 2 shows a generally preferred embodiment of a storage and propulsion cannon 60. Cannon 60 has an outer body 61 preferably made from steel or other material capable of withstanding significant pressure. Body 61 is preferably cylindrical in shape, and has an inner concentric member 62 formed of substantially smaller diameter than the diameter of body 61. Member 62 has an open end which may be partially covered by a screen 63 capable of passing air therethrough. The other end of member 62 is sealed relative to the interior of body 61 and is covered by a membrane 64 which is capable of withstanding significant pressure, but less pressure than body 61 or member 62. An explosive rupture device 65 is proximate membrane 64, and may take the form of explosive caps commonly found in industry. Explosive rupture device 65 may be exploded and actuated by an electrical signal on wire 50, as will hereinafter be described. Member 62 houses a plurality of packages 67 which are loosely packed within member 62. Packages 67 are confined within member 62 by means of the screen 63 at the open end, and by means of the membrane 64 at the other end of member 62. The remaining inner volume of body 61 is filled with pressurized gas to approximately 100 psig.

Figure 3A:
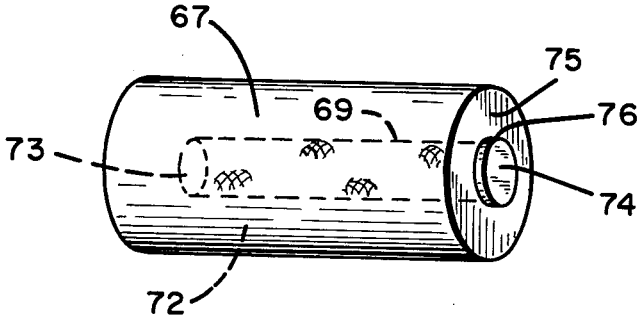
FIG. 3A shows a view of one embodiment of storing means for absorption agents.

FIG. 3A shows one embodiment of a package 67 in cylindrical form, although other embodiments of package 67 may preferably be in spherical form. Package 67 may be constructed of a very porous outer surface surrounding an inner volume filled with an absorption agent 72 in granular form. A central volume 69 may be filled with other reaction agents. Central volume 69 has an end 73 and an end 74. End 74 may be a metallic cover soldered along circumference 76 to form a closure over the end of volume 69.

It is important that the sealing solder or other sealing material 76 which affixes end 74 to the end of volume 69 be of a type which has a relatively low melting point, so that end 74 becomes opened after immersion into the smelt, to thereby cause the contents of volume 69 to be dispersed into the smelt.

Figure 3B:
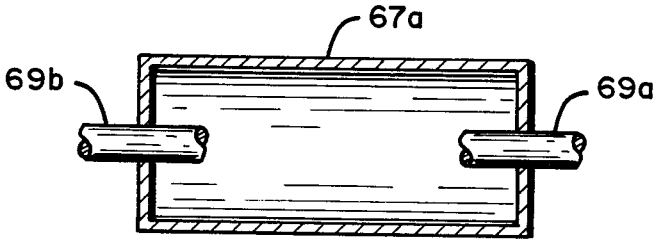
FIG. 3B shows a cross section view of a second embodiment of storing means.

FIG. 3B shows a cross section view of another embodiment of a package **67*a*. This embodiment utilizes two exit ports 69*a* and 69*b* which are constructed generally as described above with reference to volume 69. Package 67*a* may be constructed of metallic materials to contain reactive agents, but in this case it is desirable to place package 67*a* into an outer bag (not shown) wherein package 67*a*** is generally surrounded by granular absorption agents also contained within the bag. The bag should be very temperature sensitive so as to open immediately upon contact with the smelt to dispense the granular absorption agents into the smelt.

Figure 4:
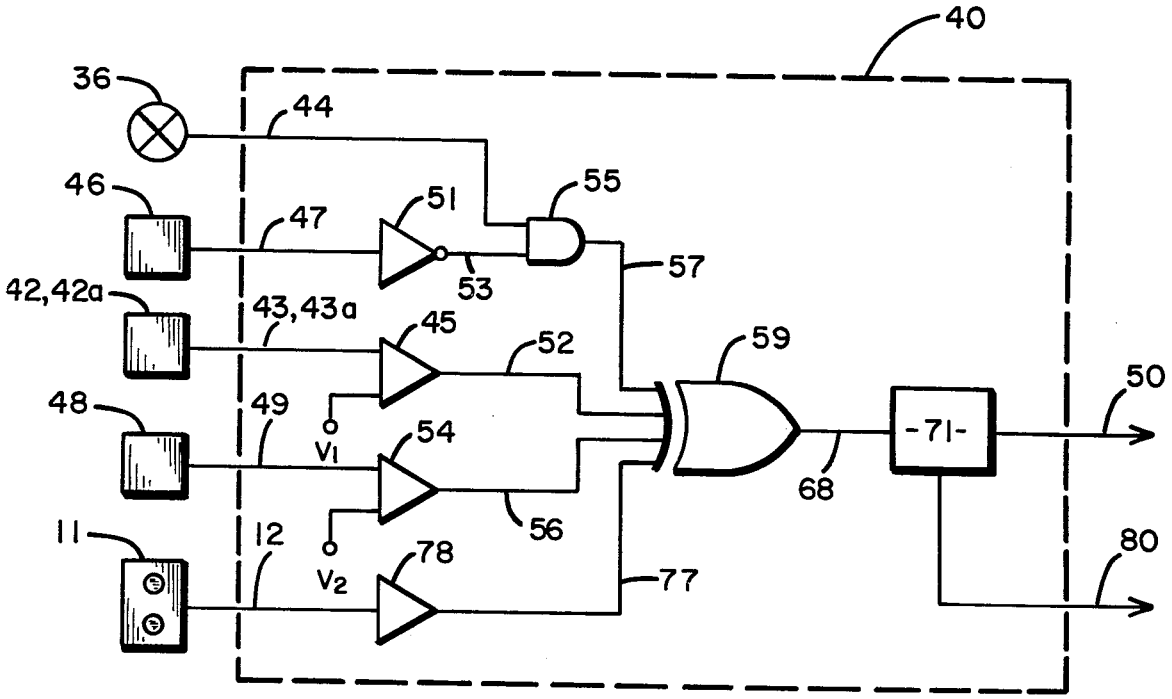
FIG. 4 shows a schematic diagram of the monitoring and control circuit.

FIG. 4 shows a symbolic diagram of the control signals in circuits which comprise control circuit 40. Flame detector 46 is coupled via line 47 to logic circuitry 51. Logic circuitry 51 and flame detector 46 are commercially available components, and logic circuit 51 functions to generate a signal on line 53 whenever flame detector 46 detects the absence of flame from nozzles 24. Line 53 is coupled to an "AND" gate 55. Flow valve 36 is electrically connected to AND gate 55 via line 44. The function of AND gate 55 is to generate a signal on line 57 whenever signals are present both on line 44 and line 53. Line 57 is coupled to an "OR" gate 59.

Pressure sensors 42 and **42*a* monitor the pressure in steam and water lines 15 and 20, and are electrically coupled to comparator circuit 45 via lines 43 and 43*a*. Comparator circuit 45 has a second input connected to a source of voltage $V_1$, and comparator circuit 45 generates an output signal on line 52 whenever the signal on line 43 or 43*a* becomes less than the signal generated at voltage $V_1$. The signal on line 43 or 43*a* is a voltage representative of pressure as monitored by pressure sensor 42 or 42*a*. Line 52 is connected at a second input into OR gate 59**.

Pressure gauge 48 is connected to monitor the water pressure in the water jacket. Pressure gauge 48 is connected to comparator 54 via line 49, and a second input line to comparator 54 is connected to a source of voltage $V_2$. Comparator 54 generates an output signal on line 56 whenever the voltage on line 49 becomes less than the voltage $V_2$. The voltage on line 49 is representative of the pressure being monitored by pressure gauge 48. Line 56 is connected as a third input into OR gate 59.

Manual station 11 is connected to generate a signal on line 12 whenever a pushbutton is depressed by an operator. Line 12 is connected to amplifier 78 which in turn is connected to OR gate 59 via line 77.

The function of OR gate 59 is to generate an output signal on line 68 whenever a signal is present at any one or more of its inputs, i.e., line 47, 56, 57, or 77. Line 68 is connected to power drive circuit 71, and a signal on line 68 will cause power drive circuit 71 to generate a voltage on output line 50 and output line 80. The signals on lines 50 and 80 may be respectively connected to storage and propulsion cannons 60, to cause activation of explosion rupture device 65, and/or to pressure ejectors 90, to cause activation of pressure nozzles and drive mechanisms. Either or both agent distribution systems may be employed to effect the protection afforded by this invention, the selection of equipment being dependent upon individual furnace layout or characteristics.

Figure 5:
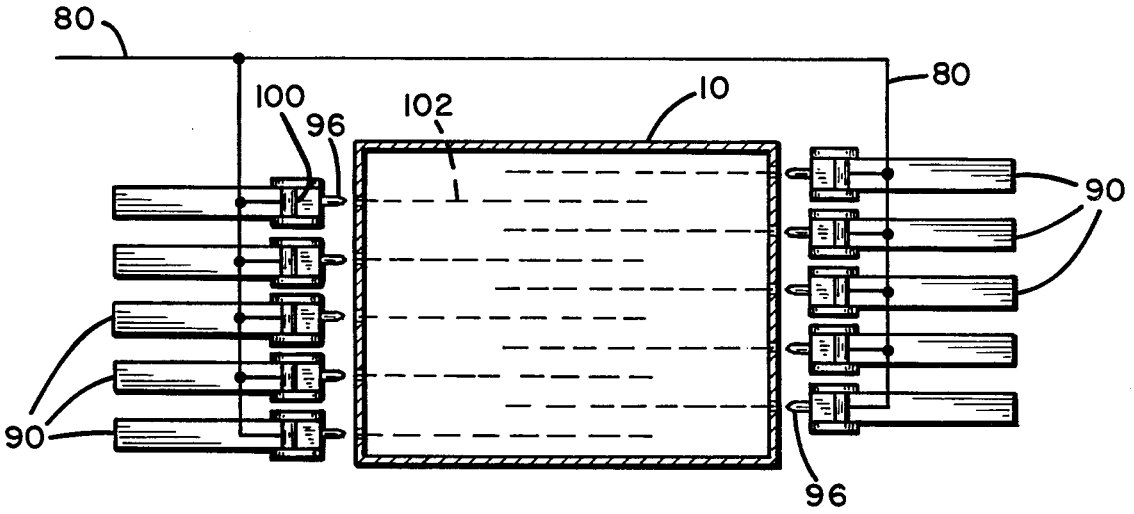
FIG. 5 shows a view taken along the lines of 5—5 of FIG. 1.

FIG. 5 shows a cross-sectional view of furnace 10 taken along the lines 5—5 of FIG. 1, but showing a different alignment of pressure ejectors 90. A plurality of pressure ejectors 90 are arranged in side-by-side relationship adjacent an exterior wall of furnace 10. In the embodiment shown, pressure ejectors 90 are divided into groups arranged along opposite sides of furance 10, although other arrangements of pressure ejectors 90 could be made within the scope of the present invention. Line 80 is connected to all of the pressure ejectors 90 in a manner to be hereinafter described. Since all of the pressure ejectors 90 are identical in construction, it will suffice to describe the operation of one of them.

Figure 6:
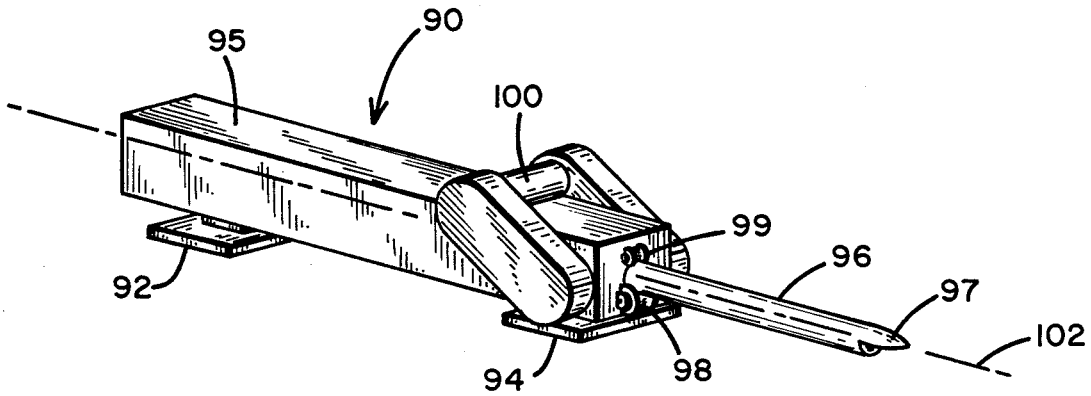
FIG. 6 shows an isometric view of a second form of propelling and storing means.

FIG. 6 shows an isometric view of a pressure ejector 90 of a type which is suitable for use with the present invention. Reference should be made to FIGS. 5–8 for an understanding of the structural details of pressure ejector 90. The general construction details of pressure ejector 90 may be adapted from a line of commercial and industrial products known as "Soot Blowers" which are originally designed for utilization and connection with high temperature furnaces. One such model of a Soot Blower which may be adapted for use in conjunction with the present invention is Model T-30 Mark 1-E, manufactured by Copes-Vulcan, Inc. of Lake City, Pa. This device is driven by two electric motors for extending and retracting a boom into the furnace, for the purpose of ejecting high-pressure air into the furance for cleaning soot and other particulate matter which may be collected on the interior pipes of the furnace. For present purposes, some of the features of this particular product need not be incorporated into the invention, as for example, the commercial product provides for selective rotation of the extensible boom as it is extended into the furnace interior, and provides for a unique nozzle arrangement not necessary for the present invention. For present purposes, it is preferable that the extensible boom be held in nonrotating position as it is inserted into and removed from the furance interior.

Pressure ejector 90 is rigidly attached to a support surface by means of mounting pads 92 and 94. An exterior housing 95 encloses the operable components to be hereinafter described. An extensible boom 96 is supported between two rollers 98 and 99, and may be extended from housing 95 or may be retracted into housing 95. A motor 100 actuates a rotary drive system for extending and retracting boom 96. Motor 100 is actuatable by a signal on line 80. Boom 96 may be extended into the interior of furnace 10 along a path, as for example path 102 in FIG. 5, so as to project approximately the entire distance across the furnace 10 interior. The respective paths of travel of the booms of all of the pressure ejectors 90 are arranged in parallel relationship, so that substantially the entire interior surface area of furnace 10 is accessible by means of one or more booms extending across the interior. Path 102 is coincidental with the axis of boom 96, which is also the axis of travel of boom 96 as it is extended outwardly from housing 95.

Figure 7:
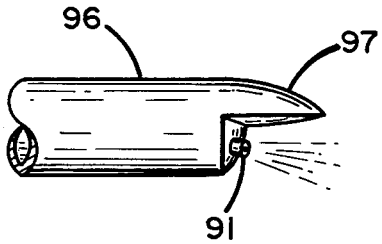
FIG. 7 shows a side view of the nozzle of the second form of propelling and storing means.
Figure 8:
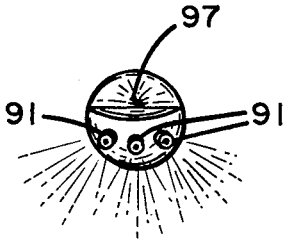
FIG. 8 shows an end view of the nozzle of FIG. 7.

Boom 96 has an end which is shaped as a deflector 97. Deflector 97 projects over a plurality of ejection openings 91 to cause particulate matter ejected from these openings to travel downwardly. Further, deflector 97 is sufficiently sharpened and pointed to provide easy penetration through a char bed inside furnace 10, even though the char bed may have developed a solid crust from accumulated material resulting from the burning process. The ejection openings 91 are arranged along a generally downwardly and arcuately spaced path so as to provide a broad discharge fan of particulate matter emitted therefrom. FIGS. 7 and 8 show preferred construction features of these components.

In operation, the actuation of line 80 not only causes boom 96 to begin extending into the interior of furnace 10, but also causes a pressurized blast through ejection openings 91, carrying granular or particulate matter of a preferred material into the smelt 32. The particulate material preferred for the purpose is silica gel ($SiO_2$) which has certain physical characteristics making it desirable for use in conjunction with the present invention. Silica gel has a melting temperature of approximately 1000° F. higher than that of the smelt, and has a density lower than the smelt, thus enabling it to be dispersed over the surface of the hot smelt bed without modifying its physical structure. Further, silica gel has the capability of absorbing water to the approximate extent of 25% of its own weight, which is a result of its own crystalline structure wherein a granule of silica gel is comprised mostly of open space surrounded by a loose crystalline network. It is the open space within a granule of silica gel which enables it to accept and absorb water molecules, accumulating the same therein through an absorption process. If silica gel granules are to be utilized in cooperation with packages 67, the packages may be assembled with a highly porous mesh covering having a sufficiently fine weave to retain the granular silica gel material, but of sufficient strength to hold the package and silica gel together as they penetrate the char bed and smelt bed. As the porous package passes through any water covering the smelt, the granules of silica gel effectively absorb the water proximate the entry point, and thereby prevent explosive interactions which might otherwise occur, due to intermixing of smelt and water as a result of the turbulence as package 67 passes through the water/smelt interface.

Silica gel granules may be used in conjunction with pressurized air or oxygen, wherein the pressurized gas entrains the silica gel particles into pressurized streams emitted from ejection openings 91 which form the nozzle of boom 96. Upon actuation of these nozzles, and as the booms are advanced into the furnace interior, the sharpened end 97 of the booms cut through the char bed close to the surface of the smelt, and the silica gel granular material is forced under pressure through a fan-shaped arrangement of the nozzle to cover a wide strip of smelt surface. Pressure ejectors 90 are spaced so as to ensure that all of the smelt surface area is covered by overlapping nozzle discharge areas.

If the entry of water into furnace 10 is from a source above the top surface of the smelt, the water will reach the silica gel on the surface of the smelt and be absorbed, effectively preventing interaction with the smelt. Alternatively, if the water is already on the surface of the smelt when the silica gel is applied thereto, the water will be immediately absorbed as the silica gel is dispersed. The silica gel receives heat from the smelt bed, and the absorbed water is evaporated to steam. As this evaporation process proceeds, it effects a cooling of the smelt bed, and when proper applications of silica gel are applied in conjunction with an orderly shutdown of the furnace, the temperature of the smelt bed may be reduced below the solidification point while dangerous reactions are avoided.

In operation, black liquor furnace 10 functions as a normal part of the overall recovery process which performs a part of the Kraft pulping process for so long as the flame in the furnace continues burning, and no water or steam leaks occur in the system. If a leak should occur in one of the steam or water lines 15 or 20, it causes an immediate pressure drop in the lines and this pressure drop is detected by pressure sensor 42. Pressure sensor 42 initiates the signals which pass through control circuit 40 and can be connected to cause activation of the storage and propulsion cannons 60. When a storage and propulsion cannon is activated membrane 64 is ruptured by explosive rupture device 65. This immediately releases pressurized air or gas confined in interior volume within body 60. This pressurized air or gas passes through opening 63 toward the ruptured membrane 64, and ejects the plurality of packages 67 out through the opening created by the ruptured membrane 64. Packages 67 are ejected toward the smelt 32, and are in fact distributed randomly throughout the volume of smelt 32. The gas used for pressurization and propulsion is preferably gaseous oxygen, but may also be pressurized air. The use of oxygen serves the double purpose of propulsion of the cannisters and oxidation of the surface of the smelt bed.

Each of the packages 67 which becomes ejected into the smelt 32 is subjected to immediate heating temperatures in the range of 1500° F.–2000° F. These high temperatures cause the porous outer cover to melt or dissolve and distribute granular absorption agent on the smelt. Subsequently, the other reaction agents in packages 67 are released into the smelt 32, in a more or less random fashion. The absorption agent effectively absorbs any water layer on the smelt, and combines with the reaction agents to remove heat from smelt.

The operation proceeds in a similar manner if water jacket 37 suffers a similar leak or break, causing water to leak into the smelt from drain spout 35. Such a water leak may cause small reactive explosions to occur in smelt drain spout 35, which will tend to propogate back toward smelt 32. The action described above is initiated to neutralize the smelt before this reaction process can be propogated back into smelt 32.

A similar safety preventive process occurs in the event flame from nozzles 24 extinguishes in the furnace 10. In this case, flame sensor 46 detects the extinguished flame, and a signal from flame detector 46 is combined with a signal from the flow valve 36 to cause the safety process to initiate whenever black liquor is flowing into furnace 10 via inlet pipe 22.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. An apparatus for preventing explosive reactions in black liquor furnaces having black liquor inlet flow pipes and spray nozzles connected to said flow pipes, caused by the addition of water to a molten smelt, comprising:

(a) means for sensing the apparent presence of water in said furnace, including radiation detection means connected to said furnace for selectively detecting the presence and absence of burning proximate said spray nozzles, and means for detecting the flow of black liquor in said flow pipes, and means connected to both said flow detecting means and said radiation detection means, for generating a warning signal when black liquor flow is detected and no radiation is detected from the proximity of said spray nozzles;

(b) means for storing an absorption agent adjacent said furnace, said means having further means for propelling said absorption agent into said smelt upon command; including at least one extensible dispensing nozzle movable from a first position outside said furnace to a second position inside said furnace; and (c) control means coupled to said sensing means, for generating a command signal upon detection of said warning signal from said sensing means, and means for connecting said command signal to said means for propelling, to activate said propelling means to cause said dispensing nozzle to extend into said furnace and to propel said absorption agent toward said smelt.

2. The apparatus of claim 1, further including steam and water pipes in said furnace, wherein said means for sensing the presence of water further comprises pressure responsive means coupled to said steam pipes for detecting variations in steam pressure.

3. The apparatus of claim 1, further including a water jacket associated with said furnace, wherein said means for sensing the presence of water further comprises pressure responsive means coupled to said water jacket for detecting variations in water pressure.

4. The apparatus of claim 1 wherein said absorption agent further comprises silica gel.

5. An apparatus for preventing explosive reactions in furnaces caused by the addition of water to a molten smelt, wherein said furnace includes a black liquor inlet flow pipe and spray nozzle connected to said flow pipe, comprising:

(a) means for sensing the apparent presence of water in said smelt, including radiation detection means for selectively detecting the presence and absence of burning proximate said nozzles in said furnace, and means for detecting the flow of black liquor in said flow pipe, and means connected to both said flow detecting means and said radiation detection means, for generating a warning signal when black liquor flow is detected and no radiation is detected from the proximity of said spray nozzle;

(b) an elongated barrel having dispensing nozzles proximate one end, said barrel nozzles being movable from a first position outside said furnace to a second position inside said furnace;

(c) means for dispensing an absorption agent under pressure through said barrel and said dispensing nozzles;

(d) control means coupled to said sensing means to receive said warning signal, for generating a command signal upon detection of said warning signal from said means for sensing; and (e) means for coupling said command signal to said barrel to cause movement thereof into said furnace and means for coupling said command signal to actuate said means for dispensing an absorption agent.

6. The apparatus of claim 5, further including steam and water pipes in said furnace, wherein said means for sensing the presence of water further comprises pressure responsive means coupled to said steam pipes for detecting variations in steam pressure.

7. The apparatus of claim 5, further including a water jacket associated with said furnace, wherein said means for sensing the presence of water further comprises pressure responsive means coupled to said water jacket for detecting variations in water pressure.

8. The apparatus of claim 5, wherein said absorption agent further comprises silica gel.

9. An apparatus for preventing an explosive reaction in a black liquor furnace having a black liquor inlet flow pipe and spray nozzles connected to the flow pipe and from water leakage in smelt therein from steam and water pipes therein, comprising:

(a) a radiation detection means connected to said furnace for selectively detecting the presence and absence of burning proximate said nozzles in said furnace;

(b) means for detecting the flow of black liquor in said flow pipe;

(c) means connected to both said flow detecting means and said radiation detection means, for generating a first signal when black liquor flow is detected and no radiation is detected from the proximity of said nozzles;

(d) pressure sensitive means for detecting pressure drops in said steam and water pipes and generating a second signal in response thereto;

(e) storage means positioned adjacent said furnace and having a membrane-sealed end projecting toward said smelt through an opening in said furnace, said storage means housing silica gel granules under pressure, for physical and chemical conversion of said smelt;

(f) an explosive device attached to said membrane, said explosive device being actuable by said first or second signal; and (g) means for coupling said first and second signal to said explosive device.

10. The apparatus of claim 9 wherein said storage means further comprises an inner chamber, a plurality of packages confined in said inner chamber by at least said membrane-sealed end, and an outer chamber.

11. An apparatus for preventing explosive reactions in furnaces cause by the addition of water to a molten smelt, wherein the furnaces include a black liquor inlet flow pipe and spray nozzles connected to said flow pipe, comprising:

(a) means for storing an absorption agent adjacent said furnace, said means having further means for propelling said absorption agent into said smelt upon command; including at least one extensible nozzle movable from a first position outside said furnace to a second position inside said furnace; and (b) manual actuation control means for generating said command, and including means for coupling said command to said means for storing; and (c) a plurality of granules of silica gel in said means for storing and serving as said absorption agent; and (d) radiation detection means connected to said furnace for selectively detecting the presence and absence of burning proximate said nozzles in said furnace; and (e) means for detecting the flow of black liquor in said flow pipe; and (f) means connected to both said flow detection means and said radiation detection means, for generating said command when black liquor flow is detected and no radiation is detected from the proximity of said spray nozzles, and including means for coupling said command to said means for storing.

12. A method of stabilizing a mixture including water and molten smelt in a black liquor furnace and boiler, wherein black liquor flows into said furnace through an inlet flow pipe and is sprayed through nozzles connected to said flow pipe in said furnace, comprising the steps of (a) monitoring the flow of black liquor through said inlet flow pipe to said furnace; and (b) detecting the radiation proximate said nozzles for determining the presence and absence of combustion proximate said nozzles; and (c) generating a signal when said combustion ceases and said black liquor flow continues into said furnace; and (d) immediately propelling an absorption agent comprising silica gel for absorbing water in said molten smelt; and (e) substantially saturating said smelt with said absorption agent.

* * * * *